United States Patent [19]

Buyofsky et al.

[11] Patent Number: 4,810,568

[45] Date of Patent: Mar. 7, 1989

[54] REINFORCED FABRIC LAMINATE AND METHOD FOR MAKING SAME

[75] Inventors: Conrad C. Buyofsky, South River; John W. Kennette, Somerville, both of N.J.

[73] Assignee: Chicopee, New Brunswick, N.J.

[21] Appl. No.: 62,356

[22] Filed: Jun. 11, 1987

Related U.S. Application Data

[63] Continuation of Ser. No. 676,604, Dec. 3, 1984, abandoned, which is a continuation of Ser. No. 462,490, Jan. 31, 1983, abandoned.

[51] Int. Cl.[4] ..... B32B 7/04

[52] U.S. Cl. ..... 428/284; 156/62.8; 156/306.6; 428/286; 428/288

[58] Field of Search ..... 156/62.2, 62.8, 181, 156/306.3, 306.6, 305, 290, 291, 292; 162/103, 115, 204; 28/104; 264/119, 128, 175; 428/227, 284, 286, 287, 288, 289, 293, 296, 297, 298, 299, 301, 221, 255, 109, 110, 913; 427/288, 361

[56] References Cited

U.S. PATENT DOCUMENTS

| | | | |
|---|---|---|---|
| 2,705,498 | 4/1955 | Johnson | 428/224 X |
| 2,705,687 | 4/1955 | Petterson et al. | 428/288 X |
| 2,705,688 | 4/1955 | Ness et al. | 428/224 X |
| 2,880,111 | 3/1959 | Drelich et al. | 428/288 X |
| 3,009,822 | 11/1961 | Drelich et al. | 428/195 |
| 3,485,708 | 12/1969 | Ballou et al. | 428/227 |
| 3,683,921 | 8/1972 | Brooks et al. | 128/296 |
| 4,082,886 | 4/1978 | Butterworth et al. | 428/284 |
| 4,154,883 | 5/1979 | Elias | 428/171 |
| 4,166,877 | 9/1979 | Brandon et al. | 428/221 |
| 4,178,407 | 12/1979 | Rubens | 428/284 |
| 4,287,251 | 9/1981 | King et al. | 428/198 |

*Primary Examiner*—Michael W. Ball
*Assistant Examiner*—Ramon B. Hoch

[57] ABSTRACT

A method of making a low cost, nonwoven reinforced fabric laminate comprising two layers of lightly entangled fibers having binder at the jet surface thereof, and having a reinforcing layer therebetween, comprising superimposing the two fibrous layers and the scrim with the non-binder side of the fibrous layers next to the scrim and securing the reinforcing layer to each of the fibrous layers.

8 Claims, No Drawings

REINFORCED FABRIC LAMINATE AND METHOD FOR MAKING SAME

This application is a continuation of application Ser. No. 676,604 filed Dec. 3, 1984 now abandoned, which in turn is a continuation of Ser. No. 462,490 filed Jan. 31, 1983, now abandoned.

BACKGROUND OF THE INVENTION

It is known to combine a reinforcing layer such as a scrim with one or two paper layers to form a reinforced towel. Reinforced wipes employing a scrim between layers of non-woven materials are also known in the art. One such structure, marketed as an industrial wipe, comprised a pulp-filled, long fiber, carded wipe with a floating scrim center, and specifically comprised a layer of long fibers, a pulp layer, the scrim, a pulp layer, and another layer of long fibers. The wipe contained binder material which extended through the layers of the wipe and anchored the scrim. The scrim was not separately bonded to the pulp. Another nonwoven reinforced fabric wipe comprised a reinforced fluid entangled fibrous wipe consisting of a layer of entangled fibers, a reinforcing scrim, and another layer of entangled fibers, said scrim being attached to the fibrous layers by heat sealing or adhesive. Entangled fiber fabrics are very expensive and difficult to produce.

The reinforced fabric laminate of the present invention comprises a cloth-like nonwoven reinforced laminate which may be made at a relatively low cost, exhibits excellent abrasion resistance, dimensional stability and absorbency. The fibrous layers used in manufacturing the laminate are lightly entangled layers with a low level of binder, sufficient to maintain the outer surface integrity of the layer. Such layers are less expensive to manufacture than the entangled fabric layers of the prior art wipes. According to the method of the present invention, the binder material is printed on one surface only of each of the fibrous layers which make up the fabric laminate, and according to the present invention, the fabric laminate is produced by a process which disposes the binder side of the fibrous layers on the outside surfaces of the fabric laminate.

SUMMARY OF THE INVENTION

The present invention comprises the method of making a low cost, nonwoven, reinforced fabric laminate comprising two layers of lightly entangled fibers and an interposed reinforcing layer. The fabric laminate has excellent abrasion resistance, dimensional stability and absorbency. Each of the fibrous layers of the fabric laminate are assembled by subjecting a web of fibers comprising absorbent fibers and high strength fibers to fluid entangling forces to form a lightly entangled fibrous layer having a jet side and a belt side, and applying binder to the jet side of each fibrous layer. The web may be dried prior to application of the binder, and the binder may be dried prior to assembling the fibrous layers into the fabric laminate.

A lightly entangled fibrous layer has greater abrasion resistance at the jet side. Binder is usually provided on the belt side of a lightly entangled fibrous layer, however, according to the method of the present invention, the surface binder is added to the jet side of each of the two fibrous layers. The fabric laminate is assembled by superimposing the first fibrous layer, a reinforcing layer and the second fibrous layer with the belt side having less abrasion resistance, next adjacent the reinforcing layer. The binder may be printed on the fibrous layers prior to forming the laminate or may be printed on the laminate. The reinforcing layer is attached to the two fibrous layers. The refinforcing layer may be thermoplastic, and may be secured to the first and second fibrous layers by the use of heat. The reinforcing layer may comprise a scrim, and in particular, a fibrous netting covered with thermoplastic material. The nonwoven, reinforced fibrous material of the present invention may be used as a wipe giving excellent abrasion resistance, dimensional stability and absorbency.

DETAILED DESCRIPTION OF THE INVENTION

The nonwoven, reinforced fabric laminate of the present invention utilizes lightly entangled fibrous layers having a pattern of high density regions interconnected by fibers extending between the regions. Such lightly entangled or entangled fibrous layers have a jet side disposed closer to the jets of fluid during the entangling process, and a belt side. The jet side has greater abrasion resistance. To said lightly entangled layers is added an effective amount of binder to give the fibrous layer the sufficient abrasion resistance and cohesiveness for the intended end-use application. These lightly entangled fibrous layers have been provided with binder throughout or with surface binder, however in the method and fabric laminate of the present invention, the fibrous layers making up the fabric laminate are produced by printing binder on the surface of the jet side of each of the lightly entangled fibrous layers. In a preferred emodiment, the layers are dried prior to print bonding.

The method of the present invention involves assembling two fibrous layers by lightly entangling a web of fibers comprising absorbent fibers and high strength fibers utilizing high speed essentially columnar jets of fluid to form the fabric layers. Binder is printed on the jet side of the layers prior to superimposing the layers in the laminate or after the layers are superimposed. The laminar structure is then assembled by superimposing the two fibrous layers with a reinforcing layer therebetween. The laminar structure is assembled so that the belt side of the entangled fibrous layers are next adjacent the reinforcing layer. The jet sides of the fibrous layers comprise the outer surfaces of the reinforced fabric laminate. The reinforcing layer is then secured to the first and second fibrous layers. If the binder is not added before the laminate is assembled, the binder may be printed on the laminate either before or after the reinforcing layer is secured to the fibrous layers. The reinforcing layer may comprise a thermoplastic material which may be heat bonded to the first and second fibrous layers. It is essential that the reinforcing layer not be destroyed in the laminating process, but remain to lend dimensional stability to the laminate. It is not essential that the reinforcing layer be thermoplastic as it may be adhesively secured to the first and second fibrous layers. The reinforcing layer may comprise a scrim or a netting. In its most preferred embodiment, the reinforcing layer comprises a fibrous netting with a thermoplastic coating.

The nonwoven, reinforced fabric laminate of the present invention and the method of making the same comprises a low cost alternative to reinforced entangled fabric laminates. The fabric laminate has good utility as a wipe, and in particular, possess excellent abrasion resistance, dimensional stability and absorbency.

Each of the nonwoven fibrous layers of the reinforced fabric laminate of the invention is made by forming a web of overlapping, intersecting fibers, supporting the web on an apertured pattern member having apertures arranged in a pattern, directing high speed jets of fluid at the web to randomly and lightly entangle the web into a fibrous layer having a pattern of high density regions interconnected by fibers extending between regions, said layer having a jet side disposed nearest the jets, and applying adhesive binder material to the jet side of the layer of lightly entangled fibers. The fibrous layer may be dried before the application of binder, and the binder may be added before or after superimposing the fibrous layers to form the laminate.

The fibrous web can be formed in any convenient known manner, as by air-laying or carding. The web is then lightly entangled using method and apparatus similar to those disclosed by Evans in U.S. Pat. No. 3,485,706. It is an important feature of the invention that the fibrous layer is lightly entangled. For instance, it is preferred that the lightly entangled fibrous layer have a structural measure of fiber entanglement of less than 0.1. (The test procedure for measuring the structural measure of fiber entanglement is set forth in copending Application U.S. Ser. No. 282,481.)

A typical apparatus for making the fibrous layer used in the process of the invention employs rows of orifices through which fluid (usually water) under pressure forms essentially columnar jets. A suitable apparatus has up to 20–25 rows of orifices, with about 30–50 orifices per linear inch. The orifices are preferably circular, with diameters of from 0.005 to 0.007 inch. The traveling fibrous web can be positioned about 1–2 inches below the orifices.

Using the above-described typical apparatus, representative conditions include a liquid pressure of about 200–700 psi and a web speed of up to 100 yards per minute, for a fibrous web weighing about $\frac{1}{2}$ to $2\frac{1}{2}$ ounces per square yard. Routine experimentation that is well within the ordinary skill in the art will suffice to determine the desired conditions for particular cases.

According to one embodiment of the method of the present invention, after the fibrous layer has been lightly entangled, it is surface bonded, preferably print bonded, by passing the fibrous layer through a print bonding station employing a set of counterrotating rolls comprising the upper (back-up) roll which is adjustable, and the lower (applicator) roll which is engraved with a predetermined pattern to be printed. The lower roll is partially immersed in a bath of binder solution or suspension. As the roll rotates, it picks up binder, and a doctor blade wipes the roll clean except for the binder contained in the engraved pattern. As the fibrous layer passes through the nip between the rolls, the binder is printed on the layer from the engraved pattern. This procedure is well known in the art. If desired the fibrous layer may also be overall saturation bonded. It is preferred that the fibrous layers be dried prior to the application of the binder material.

The adhesive binder employed can be any of the aqueous latex binders that are conventionally employed as binders for nonwoven fabrics. Such binders include acrylics, ethylene-vinyl acetate copolymers, SBR latex rubbers, and the like.

After the binder has been applied, the printed fibrous layer may be dried in the usual fashion, as by passing the web over a series of drying cans.

The binder is employed in an effective amount, that is, that amount which will result in a fibrous layer having sufficient abrasion resistance for the intended end-use application. In addition, the binder prevents disentangling of the surface fibers, thereby maintaining the cohesiveness of the fibrous layer and laminate. The exact amount of binder employed depends, in part, upon factors such as nature of binder, and the like. Usually, an effective amount will be found within the range of from about 5 to about 30 weight percent, based upon weight of fibers plus binder.

The fibers used in the reinforced fabric and process of the invention are a combination of absorbent or hydrophilic fibers such as rayon, cotton, and high strength fibers such as polyester, polyolefin, acrylic, or nylon fibers. The fibers may have a denier of from 1 to 1.5 or more and they may be in the form of short fibers such as $\frac{1}{4}$ nch in length upto as long as continuous filament fibers. Preferably, fibers in the range of $\frac{3}{4}$ to 2 inches in length are used. The weight of the fibrous layers used in the present invention may vary from 100 grains per square yard to a few thousand grains per square yard.

Though it is generally known that the presence of binder reduces absorbency, and that the jet side surface of a lightly entangled fibrous layer has greater abrasive resistance than the belt side of the fabric layer; adding binder to the jet side, or strength to strength, made possible by the use of the reinforcing layer, is not known or obvious. The fibrous layer and the fabric laminate maintain all the absorbency of the non-bonded loosely entangled belt side of the fibrous web, and require that less binder be added to the stronger jet side to achieve excellent abrasion resistance while giving good feel.

The foregoing description is illustrative but is not to be taken as limiting. Other variations and modifications are possible without departing from the spirit and scope of the present invention.

What is claimed is:

1. A method of making a low cost, nonwoven, reinforced fabric laminate having excellent abrasion resistance, dimensional stability and absorbenty comprising the steps of:

(a) lightly entangling a web of fibers utilizing high speed essentially columnar jets of fluid to form a first fibrous layer having a jet side and another side;

(b) applying binder to the jet side of the first fibrous layer to surface bond the jet side only predominantly on the surface thereof;

(c) superimposing a reinforcing layer upon the other side of said first fibrous layer;

(d) lightly entangling a web of fibers utilizing high speed essentially columnar jets of fluid to form a second fibrous layer having a jet side and another side;

(e) applying binder to the jet side of a second fibrous layer to surface bond the jet side only predominantly on the surface thereof;

(f) superimposing said second fibrous layer upon said first fibrous layer and reinforcing layer, with the other side of said second fibrous layer next adjacent the reinforcing layer; and (g) securing said reinforcing layer to each of said first and second fibrous layers.

2. The method of claim 1 wherein said fibers comprise both absorbent fibers and high strength fibers.

3. The method of claim 1 further comprising the step of drying the binder prior to superimposing the first and second fibrous layer and the reinforcing layer.

4. The method of claim 1 wherein said reinforcing layer is thermoplastic and is secured to said first and second fibrous layers by the use of heat.

5. The method of claim 1 wherein said reinforcing layer comprises a scrim.

6. The method of claim 2 wherein said absorbent fibers are cotton and/or rayon, andsaid high strength fibers are selected from the group consisting of polyester, polyolefin, acrylic or nylon fibers.

7. A method of making a low cost, nonwoven, reinforced fabric laminate having excellent abrasion resistance, dimensional stability and absorbency comprising the steps of: lightly entangling two separate webs of fibers utilizing high speed essentially columnar jets of fluid to form first and second separate fibrous layers, each having a jet side and a belt side, superimposing said first and second fibrous layers and a reinforcing layer with the belt side of the first and second fibrous layers next adjacent the reinforcing layer, and then, in either order, securing the reinforcing layer to the first and second fibrous layers, and applying binder to the jet side of the first and second fibrous layers now forming the outer surface of the fabric laminate to surface bond the jet sides only of said fibrous layers predominantly on the surface of said jet sides.

8. A nonwoven reinforced wipe having excellent abrasion resistance and absorbency made by the method of claims 1 or 7.

* * * * *

UNITED STATES PATENT AND TRADEMARK OFFICE

CERTIFICATE OF CORRECTION

PATENT NO. : 4,810,568

DATED : March 7, 1989

INVENTOR(S) : Buyofsky et al.

It is certified that error appears in the above-identified patent and that said Letters Patent is hereby corrected as shown below:

Claim 2, column 5, line 1: "claim 1" should read -- claims 1 or 7 --.

Signed and Sealed this

Fourteenth Day of November, 1989

*Attest:*

JEFFREY M. SAMUELS

*Attesting Officer* *Acting Commissioner of Patents and Trademarks*